US006168238B1

(12) United States Patent
Hannagan

(10) Patent No.: US 6,168,238 B1
(45) Date of Patent: Jan. 2, 2001

(54) CHAIR WITH CALF SUPPORT

(75) Inventor: Angus Patrick Douglas Hannagan, Waterlooville (GB)

(73) Assignee: Pegasus Egerton Limited (GB)

( * ) Notice: Under 35 U.S.C. 154(b), the term of this patent shall be extended for 0 days.

(21) Appl. No.: 08/849,278

(22) PCT Filed: Dec. 20, 1995

(86) PCT No.: PCT/GB95/02975

§ 371 Date: Feb. 19, 1998

§ 102(e) Date: Feb. 19, 1998

(87) PCT Pub. No.: WO96/19175

PCT Pub. Date: Jun. 27, 1996

(30) Foreign Application Priority Data

Dec. 20, 1994 (GB) ..... 9425664

(51) Int. Cl.[7] ..... A47C 7/50; A47C 7/52

(52) U.S. Cl. ..... 297/423.3; 297/423.4; 297/DIG. 3; 297/DIG. 4

(58) Field of Search ..... 297/423.3, 423.4, 297/DIG. 3, DIG. 4, 452.41, 284.6; 5/710, 713

(56) References Cited

U.S. PATENT DOCUMENTS

| | | | | |
|---|---|---|---|---|
| 3,261,031 | * | 7/1966 | Gates | 297/DIG. 4 |
| 3,936,893 | * | 2/1976 | Anderson et al. | 297/DIG. 4 |
| 4,017,118 | * | 4/1977 | Cawley | 297/284.6 |
| 4,745,647 | * | 5/1988 | Goodwin | 5/713 X |
| 4,795,214 | * | 1/1989 | Holdt | 297/DIG. 4 |
| 4,962,552 | * | 10/1990 | Hasty | 5/713 X |
| 4,966,413 | * | 10/1990 | Palarski | 297/284.6 |
| 5,022,385 | * | 6/1991 | Harza | 601/149 |
| 5,277,414 | | 1/1994 | Binnen . | |
| 5,433,506 | * | 7/1995 | Jensen | 297/284.6 |

FOREIGN PATENT DOCUMENTS

| | | |
|---|---|---|
| 1 595 417 | 8/1981 | (GB) . |
| 2 183 471 | 6/1987 | (GB) . |
| 2 238 237 | 5/1991 | (GB) . |
| 7901599 | 9/1980 | (NL) . |
| WO 92/02200 | 2/1992 | (WO) . |
| WO 94/07396 | 4/1994 | (WO) . |

OTHER PUBLICATIONS

"Proceedings of the Annual International Conference of the IEEE Engineering in Medicine and Biology Society", vol. 13:1991, Oct. 31–Nov. 3, 1991, 1932–1933.

* cited by examiner

*Primary Examiner*—Anthony D. Barfield
(74) *Attorney, Agent, or Firm*—Larson & Taylor, PLC

(57) ABSTRACT

A chair, particularly a wheelchair (1), has a detachable active calf support (4), which has a plurality of inflatable cushion members (A, B, C, D) providing a calf support surface for a person in the chair. The cushion members are parallel transverse tubes forming an array extending away from the chair seat (3). The chair has a control for inflating and deflating the tubes in a predetermined sequence.

6 Claims, 2 Drawing Sheets

CHAIR WITH CALF SUPPORT

TECHNICAL FIELD OF THE INVENTION

This invention relates to chairs, especially wheelchairs, and to attachments for such chairs.

BACKGROUND TO AND SUMMARY OF THE INVENTION

In essence, the present invention provides an active calf support, for a person sitting in a chair, i.e. a support which applies a pressure varying with time to regions of the calf, for stimulation of venous return in the lower limb. The applicants believe that such an active calf support has not previously been proposed.

Beds having a plurality of cushion members, e.g. transverse tubes, which are sequentially inflatable, are today well known. They are used for patients who are inactive or not sufficiently active to turn themselves regularly in bed, and who therefore run the risk of bed sores. The sequential inflation of the cushion members applies intermittent pressure to the skin, thereby reducing or preventing the formation of bed sores. An example of such a bed is the present applicants' GB-A-1595417. The present applicants have also sold active seats for particularly wheelchairs, which have a plurality of cushions members in the form of tubes extending from the front to the back of the chair, the chair carrying an air pump and a controller for sequentially inflating and deflating the tubes, as described in WO94/07396 and U.S. Pat. No. 5,277,414.

The present inventors have now realised that the provision of an active calf support will have beneficial effects for a person who is seated for long periods in a chair, such as a wheelchair. Because of the relative inactivity of such a person, and because they cannot easily exercise their legs, there is a tendency for poor circulation of the blood in the lower leg. The present invention provides means to ameliorate this, and particularly to stimulate venous return in the lower leg or lower legs.

It is mentioned that inflatable pads which are strapped around the calf are believed to be known, as also are boots containing inflatable pads which contact the lower leg. It seems that these are intended to be used by an active person, who desires massage of the muscles of the lower leg, and are intended to be used with the lower leg in a vertical position.

NL 7901599 discloses a chair with a tilting calf massaging cushion which is driven by a motor via an eccentric.

According to the present invention in one aspect, there is provided a chair having a seat and a calf support extending forwardly away from the seat, the calf support comprising a plurality of inflatable cushion members providing a support surface for at least one calf of a person sitting in the chair, the chair being provided with control means for inflating and deflating the cushion members in a predetermined sequence.

The cushion members may be any suitable size and shape. Tubes extending transversely to the direction of a leg of a person sitting in the chair (herein called "the forward direction") are preferred. The cushion members are preferably in an array extending in the forward direction, and preferably there are at least three, more preferably at least four cushion members in the array in the forward direction. For practical reasons, relating to the construction of transverse tubes and the requirement for inflation and deflation, an array of four tubes in the forward direction is most suitable.

The length of each cushion member in the forward direction, e.g. the width of a tube whose longitudinal direction is transverse to the forward direction, is preferably in the range 40 mm to 100 mm, more preferably 60 mm to 100 mm.

When there are at least three cushion members in the array in the forward direction, the control means for sequentially inflating and deflating the cushion members is preferably arranged to inflate and deflate the cushion members in a sequence such that a pressure wave travels upwardly along the lower leg of the person sitting in the chair, i.e. towards the trunk of the person. The effect of inflation and deflation of the cushion members in itself stimulates venous return and improves muscle tone, by encouraging the normal physiological processes in the lower leg, and the provision of a pressure wave moving upwardly along the leg, may, it is thought, further encourage venous flow. Suitable control systems for inflating and deflating the cushion members in the desired sequence are known, for example, from the patent specifications mentioned above and from GB-A-2183471 and GB-A-2238237.

The calf support may be mounted on the chair so as to be movable between two positions, i.e. a stowage position in which it is at or close to vertical and essentially does not support the calf of a person seated in the chair and a use position in which the surface of the cushion members which contact the calf extends in the forward direction at an angle of at least 45° to the vertical, preferably at least 60° to the vertical.

The calf support may have an attachment portion, e.g. a frame portion which is releasably attachable to the chair, particularly to the frame of a wheelchair, and a support member for the cushion members which is movable, e.g. rotatable about an axis, relative to the frame portion, to bring the cushion members from the stowage position to the use position. The cushion members may be adjustable in the forward direction along the support member. The angle of the support surface to the vertical in the use position may be adjustable.

It will be understood that the active calf support provided by the present invention uses the weight of the lower leg of the user, to provide pressure at the interface between the lower leg and the cushion members when inflated. When deflated, the cushion members are preferably be vented to atmosphere, so that they apply only a residual pressure to the calf, permitting free circulation in the lower leg.

The cushion members preferably have a sufficient width, transverse to the forward direction, to accommodate both legs of the person in the chair. The cushion members may be suitably contoured in both the forward direction and the transverse direction, to provide a comfortable support for the user.

The present invention in another aspect provides a calf support attachment for a chair, e.g. a wheelchair, comprising a plurality of inflatable cushion members, a support for the cushion members supporting them so that they provide a support surface suitable for at least one calf of a person, and attachment means for mounting the attachment to a chair so that a person sitting on the chair can rest a calf of a leg extending away from the chair seat on the inflatable cushion member. Particularly, when intended for a wheelchair, the attachment means preferably is constituted by a frame portion securable to the wheelchair frame. Preferably the attachment includes a means for adjustably supporting the cushion support at a predetermined angle relative to the vertical. Preferably the cushion support additionally has a stowage position in which the cushion members substantially do not support the lower leg of a user.

Preferred and optional features of the calf support attachment of the invention are discussed above.

DESCRIPTION OF AN EMBODIMENT OF THE INVENTION

An embodiment of the present invention will now be described by way of example, with reference to the accompanying drawings in which.

Figure 1:
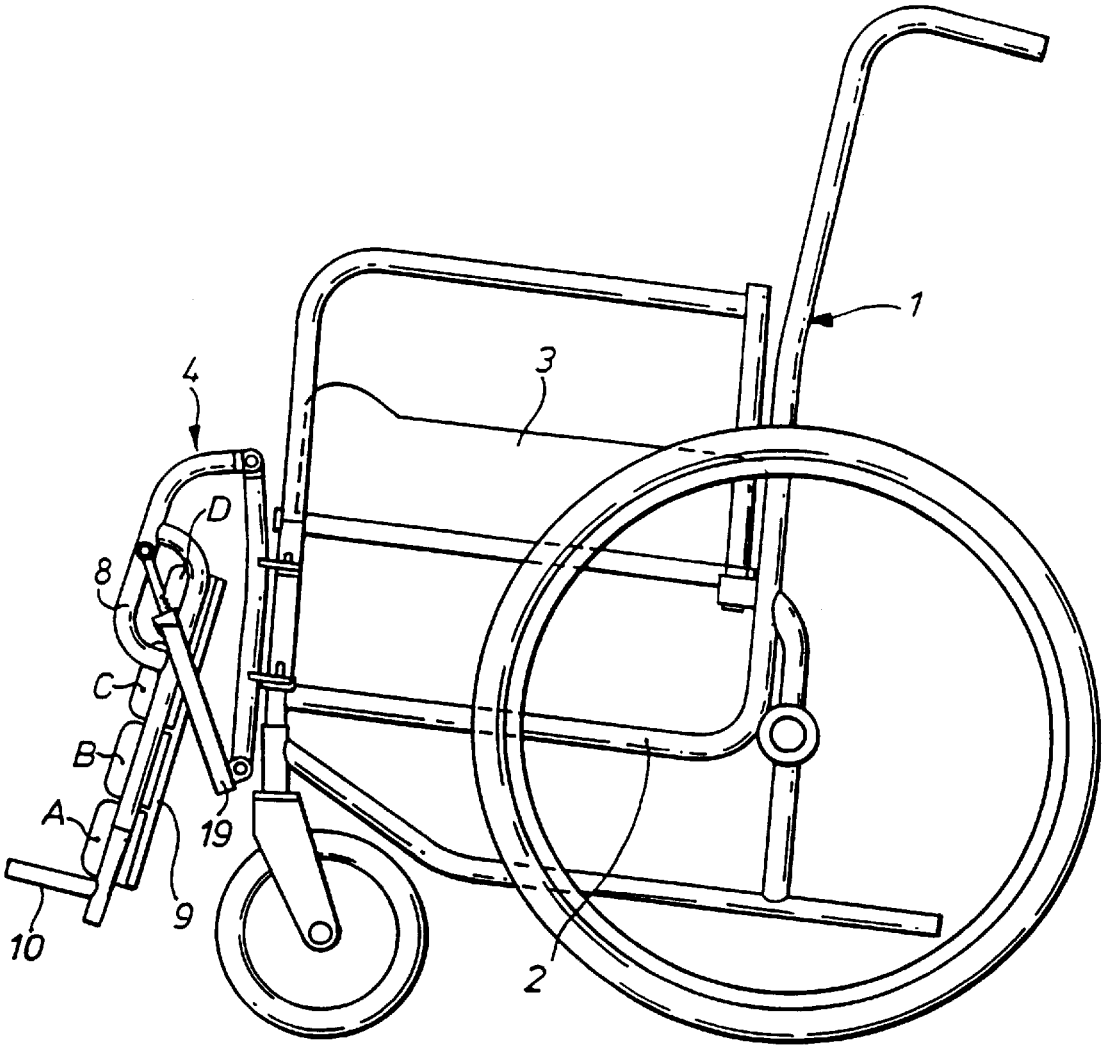
FIG. 1 is a side view of a wheelchair embodying the invention.

FIG. 1 shows a wheelchair 1 which has a conventional frame structure 2 and has a seat 3 whose sitting surface is provided by a plurality of inflatable tubes aligned in the front to back direction of the chair. Under the seat is mounted a control system and a pressurised air supply system (not shown). Reference should be made to our co-pending application WO94/07396 for a full description of this seat and the control and inflation system. The system includes its own power supply in the form of one or more batteries.

Mounted on front members of the frame structure 2 is a calf support attachment 4, which has bolt members 5 on a frame portion 6 (see FIG. 2) by which the attachment 4 is detachably secured to the wheelchair. The frame portion 6 has two upright members, of which one can be seen in FIGS. 1 and 2, and cross-members (not shown).

Figure 2:
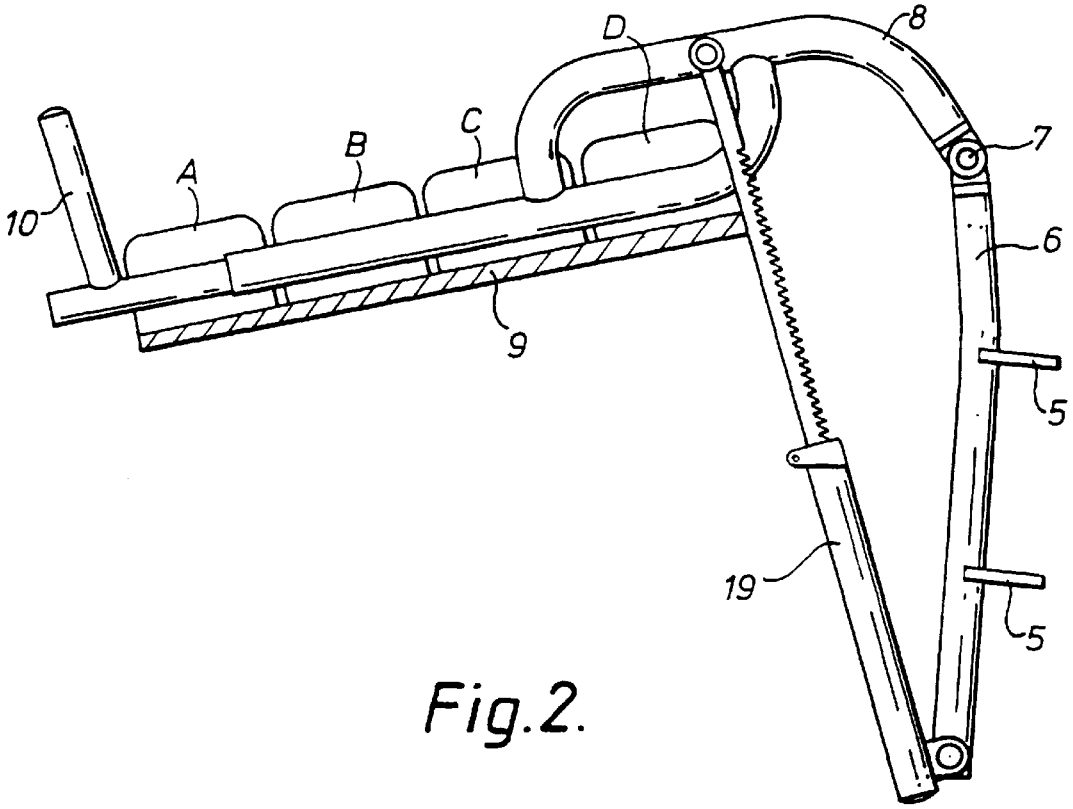
FIG. 2 is a side view of the calf support attachment of the wheelchair of FIG. 1, shown in its use position.

Pivotally mounted on the frame portion 6, at the axis 7 is a rectangular secondary frame 8 of which one longitudinal side is seen in FIGS. 1 and 2, and whose pivoting position relative to the frame portion 6 is controlled and adjusted by means of a pair of conventional ratchet support devices 19, one of which is seen in FIGS. 1 and 2. The ratchet devices 19 permit the secondary frame 8 to be located at any position between a stowage position shown in FIG. 1 and an almost horizontal use position shown in FIG. 2.

The secondary frame 8 has at its end a footrest 10 on which the user, while sitting in the wheelchair 1, may rest his or her feet, particularly when the attachment 4 is in its stowage position shown in FIG. 1.

The frame 8 carries a support board 9 which carries in turn an array of four inflatable tubes A, B, C, D of plastics material which have their longitudinal directions transverse to the forward direction of the calf support, i.e. the direction away from the front of the seat of the wheelchair. These four tubes A, B, C, D are formed of flexible air-impermeable plastics material by a moulding process so that they have an approximately rectangular cross sectional shape as seen in FIG. 2, when inflated. Their length in the forward direction, i.e. their width transverse to their own longitudinal direction is 80 mm, so that the total length in the forward direction of the support surface which they provide for the leg of a user is about 32 cm. The length of the tubes is 35 cm.

Figure 4:
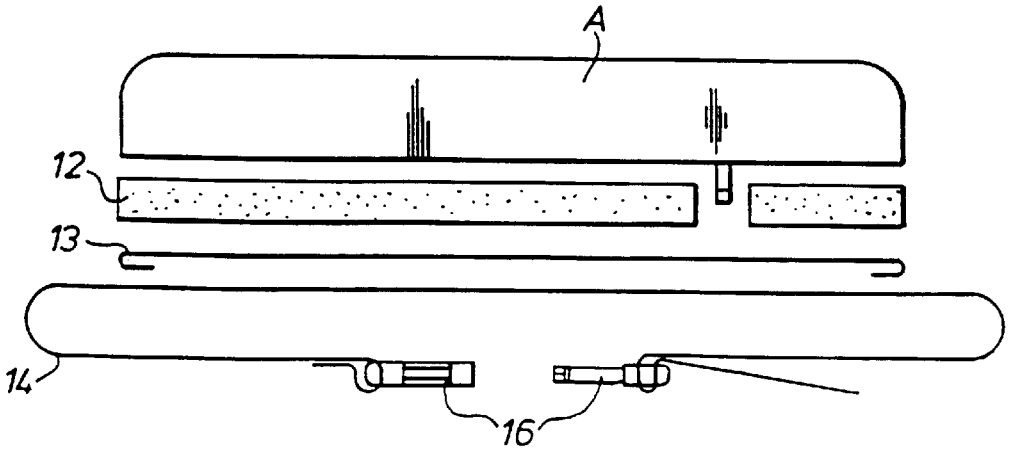
FIG. 4 is an explanatory diagram, corresponding to a transverse section of the support construction of FIG. 3.
Figure 3:
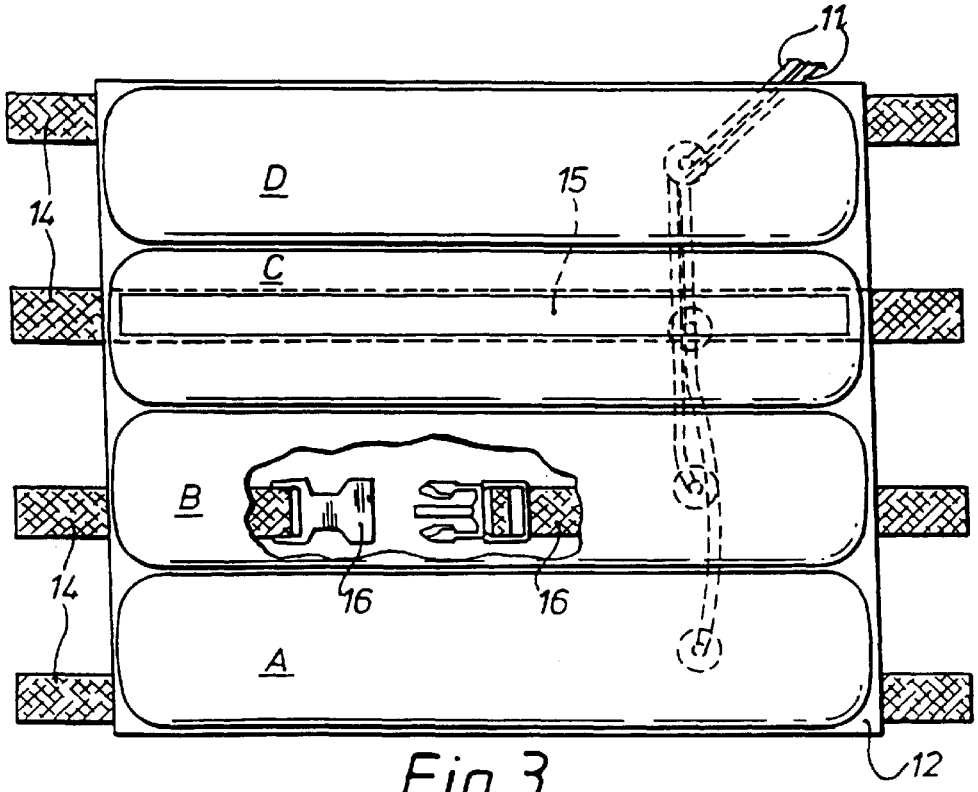
FIG. 3 is a plan view of the calf support portion of the attachment of FIG. 2.

FIGS. 3 and 4 show how the tubes A, B, C, D are mounted on the support board 9. FIG. 3 also shows air feed pipes 11 connected to the tubes A, B, C, D. In practice there are four such air feed pipes 11, one for each tube A, B, C, D. The bottom surfaces of the tubes A, B, C, D are adhesively secured to a foam layer 12 which in turn is adhesively secured to a canvas backing sheet 13. Four straps 14 are stitched to the backing sheet 13, under the tubes A, B, C, D, at the region 15 shown for tube C in FIG. 3, and each strap 14 has at its ends the components of a buckle 16, so that the four straps 14 can be strapped around the support board 9 and tightened, to secure the tube assembly in place. However, the exact location of the tube assembly on the board 9 can be adjusted, by moving the straps along the board 9.

The four tubes A, B, C, D are connected by the air feed pipes 11 to the air distributor (not shown) of the wheelchair. As mentioned above, this air distributor is of a type already known in this art, and has a rotor and a stator, which by covering and uncovering of air passages control the inflation and deflation of the four tubes A, B, C, D of the calf support 4 as well as the inflation and deflation of the tubes of the seat 3 of the wheelchair. The wheelchair also carries a compressor for supply of the inflation air, and a power supply for the air distributor and the compressor, and appropriate control equipment.

The inflation pressure supplied to the tubes A, B, C, D of the calf support 4 is the same as that supplied to the seat 3. Deflation is by venting to atmosphere, and this is controlled by the air distributor described above. Venting to atmosphere is sufficient to reduce the interface pressure at the skin of the user to the desired low level. The overall inflation cycle for the four tubes A, B, C, D is 12 minutes, but the length of this inflation cycle is not critical. The inflation cycle is chosen so as to provide a pressure wave moving slowly upwardly along the leg of the user, i.e. towards the seat of the wheelchair. A suitable inflation cycle is as follows A deflated, B C D inflated 3 minutes B deflated, A C D inflated 3 minutes C deflated, A B D inflated 3 minutes A B C inflated, D deflated 3 minutes Between each of these four stages of the cycle, there may be a short period (e.g. only a few seconds) when all four tubes A, B, C, D are inflated, or alternatively there may be a cross-over period when two of the tubes are partially inflated.

The interface pressure at the skin of the calf of the user is determined by the pressure in the tubes A, B, C, D, since the contact area will be determined by the weight applied by the user to the tubes. The cyclic application of pressure and its withdrawal on deflation of the tube has beneficial physiological effects on the user, particularly stimulating venous return and improving muscle tone. The wave effect, i.e. the effect of the pressure wave moving towards the wheelchair seat, is also thought to assist venous return.

There may be a cloth covering over the top surface of the tubes A, B, C, D. The user may rest one or both legs on the support, and can freely move the leg or legs across the support.

What is claimed is:

1. A chair comprising:

a seat;

a calf support releasably and detachably mounted on the seat and extending in a forward direction from said seat, said calf support having at least four inflatable cushion members arranged one closely adjacent the next in an array, said cushion members of said array extending one after the other in the forward direction from said seat and the array being of a length in said forward direction to provide a support surface for at least one calf of a person sitting on said seat; and a control means for inflating and deflating said cushion members automatically and cyclically in a predetermined sequence in which each one of said cushion members is periodically deflated to thereby provide pressure relief to the calf of the person sitting on said seat while the other cushion members are in an inflated state the order of deflation of said cushion members in said predetermined sequence being such that a pressure wave travels in an upward direction along that the lower leg of the person sitting on said chair.

2. A chair according to claim 1 wherein said cushion members are parallel tubes extending transversely to the forward direction.

3. A chair according to claim 1 wherein the calf support is mounted on the chair so as to be movable between a stowage position and a use position, the surface of the cushion members providing support for the user extending in the forward direction at an angle of at least 45° to the vertical in the use position.

4. A chair according to claim 1 which is a wheelchair (1).

5. A chair as claimed in claim 1, wherein said cushion members have upper surfaces which are uncovered, such that said upper surfaces make direct contact with the calf of the person.

6. A chair as claimed in claim 1, wherein said calf support is carried by said seat and is adjustable so as to vary its angular position relative to said seat.

* * * * *